US009457356B2

(12) United States Patent
Cho et al.

(10) Patent No.: US 9,457,356 B2
(45) Date of Patent: Oct. 4, 2016

(54) PARTICLE SEPARATION APPARATUS

(71) Applicant: KOREA INSTITUTE OF GEOSCIENCE AND MINERAL RESOURCES (KIGAM), Daejeon (KR)

(72) Inventors: Yong Chan Cho, Daejeon (KR); Jae Gon Kim, Daejeon (KR); Jung Hwa Lee, Daejeon (KR); In Hyun Nam, Daejeon (KR); Chul Min Chon, Daejeon (KR)

(73) Assignee: KOREA INSTITUTE OF GEOSCIENCE AND MINERAL RESOURCES (KIGAM), Daejeon (KR)

( * ) Notice: Subject to any disclaimer, the term of this patent is extended or adjusted under 35 U.S.C. 154(b) by 2 days.

(21) Appl. No.: 14/571,792

(22) Filed: Dec. 16, 2014

(65) Prior Publication Data

US 2016/0121340 A1 May 5, 2016

(30) Foreign Application Priority Data

Oct. 31, 2014 (KR) ..... 10-2014-0150072

(51) Int. Cl.

| | |
|---|---|
| ***B07B 9/00*** | (2006.01) |
| ***B03B 7/00*** | (2006.01) |
| ***B07B 1/28*** | (2006.01) |
| ***B03B 5/28*** | (2006.01) |

(52) U.S. Cl.
CPC . *B03B 7/00* (2013.01); *B03B 5/28* (2013.01); *B07B 1/28* (2013.01)

(58) Field of Classification Search
CPC ..... B07B 1/28; B07B 1/34; B03B 5/28
USPC ..... 209/17, 269
See application file for complete search history.

(56) References Cited

U.S. PATENT DOCUMENTS 3,109,808 A * 11/1963 Greenwell ..... G01N 15/0272 209/237
4,552,654 A * 11/1985 Mansker ..... B03B 5/18 209/425
5,398,851 A * 3/1995 Sancoff ..... A61M 5/14593 222/386.5
9,145,251 B2 * 9/2015 Minnette ..... B65D 79/005

FOREIGN PATENT DOCUMENTS

JP 2006-35103 A 2/2006

OTHER PUBLICATIONS

Korean Office Action dated Jan. 15, 2015; Appln. No. 10-2014-0150072.

* cited by examiner

*Primary Examiner* — Terrell Matthews
(74) *Attorney, Agent, or Firm* — Ladas & Parry LLP

(57) ABSTRACT

Provided is a particle separation apparatus. The particle separation apparatus for separating soil by particle size in a wet-type separation manner includes a body unit providing a space in which a mixture of the soil and water is received to flow vertically, a screen unit coupled to the inside of the body unit to separate the soil by the particle size from the mixture that flows vertically, and a space adjustment unit coupled to a lower portion of the body unit to cover the lower portion of the body unit, the space adjustment unit adjusting a volume of a lower space of the body unit to allow the mixture to repeatedly flow in a vertical direction.

9 Claims, 4 Drawing Sheets

PARTICLE SEPARATION APPARATUS

CROSS-REFERENCE TO RELATED APPLICATIONS

This U.S. non-provisional patent application claims priority under 35 U.S.C. §119 of Korean Patent Application No. 10-2014-0150072, filed on Oct. 31, 2014, the entire contents of which are hereby incorporated by reference.

BACKGROUND OF THE INVENTION

The present invention disclosed herein relates to a particle separation apparatus for separating soil having various particles by particle size in a wet-type separation manner, and more particularly, to a particle separation apparatus for separating soil by particle size while the soil and water repeatedly flow through a screen in a vertical direction.

Soil particles vary in physical and chemical property according to their sizes. For example, as each of soil particles decreases in size, the soil particles may increase in chemical reactivity, and also, if the soil particles exist together with water, the soil particles may increase in mobility due to an advection phenomenon. Thus, it is necessary to separate soil particles by particle size. For example, when polluted soil is purified, since pollution distribution changes according to particle sizes, optimum purification method may be performed according to the particle sizes. Also, when a geochemistry map is mapped, deposit soil in river has to be analyzed by collecting particles having specific sizes.

If it is intended to separate the soil particles according to their sizes, in case of soil particles having sizes of about 100 μm or less, it may be difficult to perform effective sieving separation. Also, if it is intended to disperse soil by using a dispersing agent, the oil has to be separated by using a sieve in a wet-type separation manner. Here, the more the particle sizes decrease, the more it is difficult to perform sieving separation.

To solve these limitations, the inventors of the present invention have studied for a long time to complete the present invention.

Korean Patent Registration No. 10-1068517 (registered on Sep. 22, 2011), titled "Particle Separation Apparatus of Solid Particles using Fluidized Bed" is disclosed as the related art.

SUMMARY OF THE INVENTION

The present invention provides a particle separation apparatus in which a mixture of soil and water repeatedly passes through a screen unit in a vertical direction to allow the soil having a particle size less than a gradation size of the screen unit to pass through the screen unit and allow the soil having a particle size greater than the gradation size of the screen to be filtered on the screen unit, thereby separating the soil by particle size with respect to the screen.

The present invention also provides a particle separation apparatus in which a screen is horizontally vibrated to perform screen separation, like a dry-type sieving separation.

Embodiments of the present invention provide a particle separation apparatus for separating soil by particle size in a wet-type separation manner, the particle separation apparatus including: a body unit providing a space in which a mixture of the soil and water is received to flow up and downwards; a screen unit coupled to the inside of the body unit to separate the soil by the particle size from the mixture that flows up and downwards; and a space adjustment unit coupled to a lower portion of the body unit to cover the lower portion of the body unit, the space adjustment unit adjusting a volume of a lower space of the body unit to allow the mixture to repeatedly flow in a vertical direction.

In some embodiments, the space adjustment unit may include a rubber membrane having elasticity.

In other embodiments, the particle separation apparatus may further include a power supply unit coupled to a lower portion of the rubber membrane to move a central part of the rubber membrane up and downwards, thereby adjusting the volume of the lower space of the body unit.

In still other embodiments, the power supply unit may include a first power part coupled to the central part of the rubber membrane to move the central part of the rubber membrane up and downwards in a cam manner.

In even other embodiments, the first power part may include: a power source for proving a rotation force by an manual operation or a motor; a rotor receiving the rotation power from the power source to rotate; and a first transmission part having one end eccentrically coupled to the rotor and the other end coupled to the central part of the rubber membrane to convert the rotation force of the rotor into a vertical moving force, thereby transmitting the converted vertical moving force into the rubber membrane.

In yet other embodiments, the power supply unit may include a second power part coupled to the central part of the rubber membrane to vertically move the central part of the rubber membrane in a piston manner.

In further embodiments, the second power part may include: a piston part for providing a vertical moving force; and a second transmission part having one end that is vertically reciprocated within the piston part and the other end coupled to the central part of the rubber membrane to transmit the vertical moving force of the piston part into the central part of the rubber membrane.

In still further embodiments, the particle separation apparatus may further include a support unit supporting the body unit so that the body unit is spaced apart from the ground.

In even further embodiments, the support unit may include: a plurality of supports disposed on the ground; and an elastic support part coupled between each of the plurality of supports and the body unit to allow the body unit to be movable in a lateral direction.

In yet further embodiments, the elastic support part may include a spring.

In much further embodiments, the screen unit may be detachably coupled to the body unit.

BRIEF DESCRIPTION OF THE DRAWINGS

The accompanying drawings are included to provide a further understanding of the present invention, and are incorporated in and constitute a part of this specification. The drawings illustrate exemplary embodiments of the present invention and, together with the description, serve to explain principles of the present invention. In the drawings.

Figure 1:
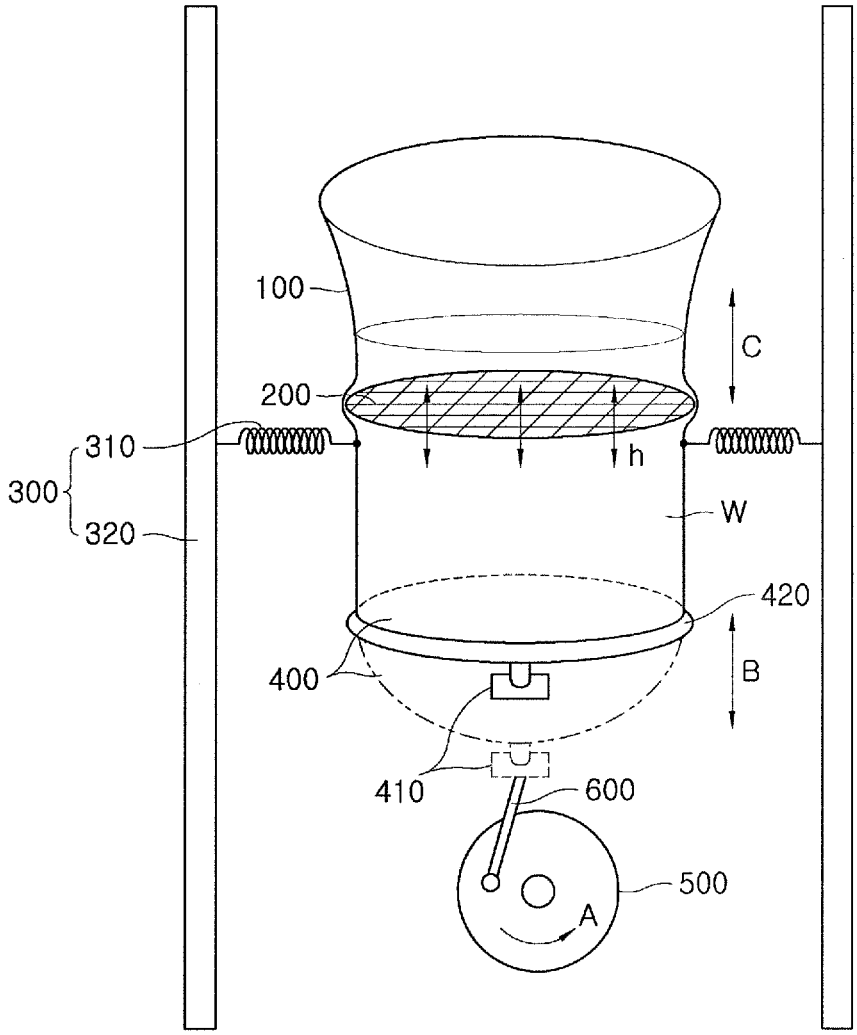
FIG. 1 is a view of a particle separation apparatus according to an embodiment of the present invention.

The attached drawings are presented for purposes of explanation only, and the technical scope of the present invention is not limited thereto.

DETAILED DESCRIPTION OF PREFERRED EMBODIMENTS

Since the present invention may have diverse modified embodiments, preferred embodiments are illustrated in the drawings and are described in the detailed description of the invention. However, this does not limit the present invention within specific embodiments and it should be understood that the present invention covers all the modifications, equivalents, and replacements within the idea and technical scope of the present invention. Moreover, detailed descriptions related to well-known functions or configurations will be ruled out in order not to unnecessarily obscure subject matters of the present invention.

It will be understood that although the terms of first and second are used herein to describe various elements, these elements should not be limited by these terms. The terms are only used to distinguish one component from other components.

In the following description, the technical terms are used only for explaining a specific exemplary embodiment while not limiting the present invention. The terms of a singular form may include plural forms unless referred to the contrary. The meaning of 'include' or 'comprise' specifies a property, a region, a fixed number, a step, a process, an element and/or a component but does not exclude other properties, regions, fixed numbers, steps, processes, elements and/or components.

Hereinafter, the particle separation apparatus of the present invention is described in more detail with reference to the accompanying drawings and, while describing of the accompanying drawings, the same or corresponding components are given with the same drawing number, and its overlapping description will be omitted.

A particle separation apparatus according to an embodiment of the present invention may separate soil by particle size in a wet-type separation manner. Referring to FIG. 1, the particle separation apparatus includes a body unit 100, a screen unit 200, and a space adjustment unit 400 so that a mixture W in which soil and water are mixed with each other repeatedly passes through a screen to separate soil by particle size. Particularly, in case of soil containing particles each of which has a very small size of about 100 μm an or less, the mixture W may repeatedly pass through the screen to improve a particle separation rate.

The body unit 100 according to the present invention provides a space in which the mixture W in which the soil and water are mixed with other are received to flow up and downwards. As illustrated in FIG. 1, the body unit 100 may have a cylindrical shape. Alternatively, the body unit 100 may have various shapes such as a rectangular pillar shape and a triangular pillar shape. The body unit 100 may have an opened upper portion, and thus the mixture W of the soil and water may be injected into the body unit 100.

The screen unit 200 may be coupled to an inner central portion of the body unit 100 to filter soil having a particle size greater than a gradation size of the screen unit 200 from the mixture W that flows up and downwards. Thus, the soil having a particle size less than the gradation size of the screen unit 200 may move together with water downward from the screen unit 200. On the other hand, the soil having a particle size greater than the gradation size of the screen unit 200 may stay as it is. As a result, the soil may be divided by particle size and then separated in upper and lower portions of the screen unit 200.

Here, the screen unit 200 may be detachably coupled to the body unit 100. Since the screen unit 200 is detachably coupled, various screen units 200 having various gradation sizes may be replaced to separate soil having various particle sizes. That is, the screen unit 200 may be installed to be suitable for kinds or sizes of soil, thereby efficiently separating the soil.

Also, the screen unit 200 may be provided in plurality within the body unit 100. That is, the plurality of screen units 200 may be vertically disposed within the body unit 100. Here, the screen units 200 may have gradation sizes different from each other. That is to say, the screen units 200 may have gradation sizes that gradually increase upward. Thus, the soil having the largest particle size may be filtered on the uppermost screen unit 200, and the soil having the next largest particle size may be filtered on the next uppermost screen unit 200. The soil having the smallest particle size may be filtered on the lowermost screen unit 200. As described above, the plurality of screen units 200 having the various gradation sizes may be successively disposed within the body unit 100 to separate the soil having the various particle sizes at once according to their sizes, thereby realizing very efficient and economical separation.

The space adjustment unit 400 may be a fundamental unit. The space adjustment unit 400 may adjust a volume of a lower space of the body unit 100 to allow the mixture W of the water and soil, which is received in the body unit 100, to vertical flow. That is, the space adjustment unit 400 may cover a lower portion of the body unit 100 to prevent the mixture W received in the body unit 100 from leaking. Also, the space adjustment unit 400 may adjust a size of the lower portion of the body unit 100 to allow the mixture W received in the body unit 100 to flow up and downwards according to the size of the lower portion of the body unit 100. That is to say, when the lower space of the body unit 100 increases in volume, the mixture W received in the body unit 100 may flow downward. On the other hand, when the lower space of the body unit 100 decreases in volume, the mixture W received in the body unit 100 may flow upward. While the mixture W within the body unit 100 flows upward or downward, the mixture W may repeatedly pass through the screen unit 200 disposed in a central portion of the body unit 100. As the mixture W repeatedly moves, the oil having a particle size less than the gradation size of the screen unit 200 may mostly move downward.

The case in which the plurality of screen units 200 are provided in the body unit 100 may be the same. That is, the screen units 200 having the various gradation sizes may be successively provided in gradation size from small to large within the body unit 100, and then the mixture W may repeatedly pass through the various screen units 200 to efficiently separate the soil according to the gradation sizes of the screen units 200.

Here, the space adjustment unit 400 may include a rubber membrane having elasticity. That is, the rubber membrane may be disposed to cover the lower portion of the body unit 100. Then, the rubber membrane may be vertically stretched by the elasticity thereof to adjust the volume of the inner space of the body unit 100. Here, the rubber membrane may firmly seal the lower portion of the body unit 100 by using a rubber band 420.

Here, the rubber membrane may be merely an example of the space adjustment unit 400. Other units that are capable of adjusting the volume of the inner space of the body unit 100, like the rubber membrane, while covering the lower portion of the body unit 100 may also be applicable.

FIG. 1 illustrates a state in which the rubber membrane is stretched downward by being pulled downward, and thus the inner space of the lower portion of the body unit 100 is expanded. As the lower space of the body unit 100 is expanded, the mixture W received in the body unit 100 may flow downward. When the force for pulling the rubber membrane is removed, the rubber membrane may return to its original state by the elasticity itself. Thus, the inner space of the lower portion of the body unit 100 may return to its original size, and the mixture W may flow upward. Since the mixture W moves upward or downward, the mixture W may repeatedly pass through the screen unit 200 to improve separation efficiency of the screen unit 200 according to the particle sizes.

Figure 2:
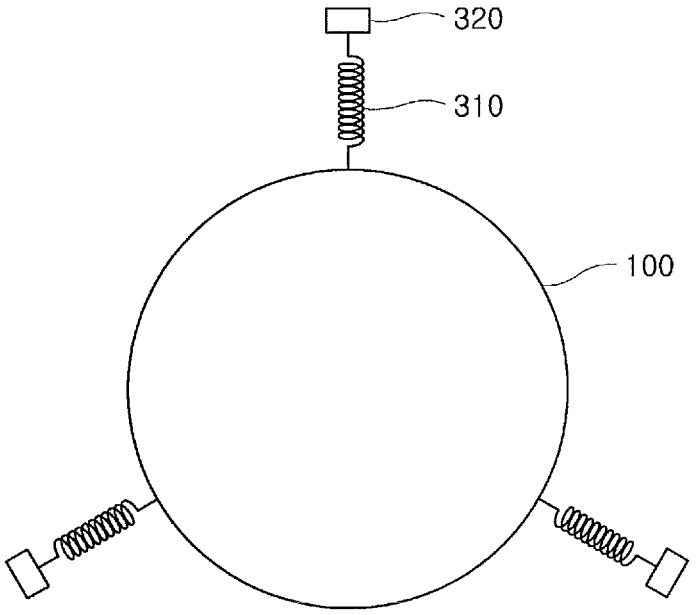
FIG. 2 is a plan view of the particle separation apparatus according to an embodiment of the present invention.

FIG. 2 is a plan view of the particle separation apparatus according to an embodiment of the present invention. The particle separation apparatus may include a support unit 300 for spacing the body unit 100 apart from the ground S. The support unit 300 includes a plurality of supports 320 disposed perpendicularly on the ground S and a plurality of elastic support parts 310 coupling the plurality of supports 320 to the body unit 100. As illustrated in FIGS. 1 and 2, the elastic support parts 310 may be a device having elasticity such as a spring. Also, the elastic support parts 310 may be provided in three to stably support the body unit 100. Here, the elastic support parts 310 may be coupled between the plurality of supports 320 and the body unit 100 to space the body unit 100 apart from the ground S, thereby guiding lateral movement of the body unit 100. That is, the plurality of elastic support parts 310 coupled between the supports 320 and the body unit 100 may convert a lateral moving force of the body unit 100 that is transmitted from the outside into an elastic force and restoring force of the elastic support parts 310 to repeatedly vibrate the body unit 100 in a lateral direction.

Since the elastic support parts 310 repeatedly vibrate the body unit 100 in the lateral direction, the screen separation by the lateral vibration that is used in a dry-type particle separation method may be additionally performed. The body unit 100 may be vibrated in a front/rear direction or a later direction that is a third direction to more improve the particle separation efficiency.

If the body unit 100 is pulled to slightly get out of a center thereof when the body unit 100 is pulled downward, the lateral movement of the body unit 100 may occur. Here, the lateral movement may be converted into the elastic force and restoring force of the elastic support parts 310.

That is, the particle separation apparatus according to the present invention may include the space adjustment unit 400 and the elastic support parts 310. Thus, the mixture W within the body unit 100 may repeatedly vertically pass through the screen unit 200 while being vibrated in the left/right direction to more improve the particle separation efficiency.

Figure 3:
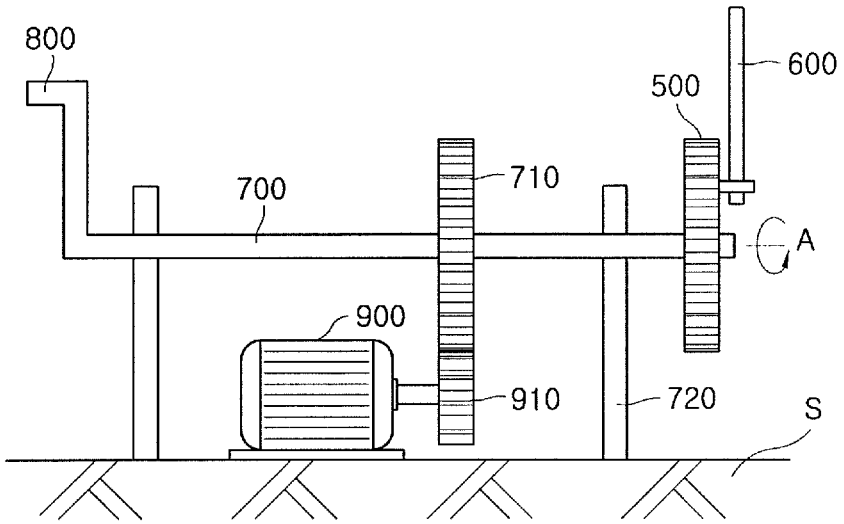
FIG. 3 is a view of a power supply unit including a first power part of the particle separation apparatus according to an embodiment of the present invention.
Figure 4:
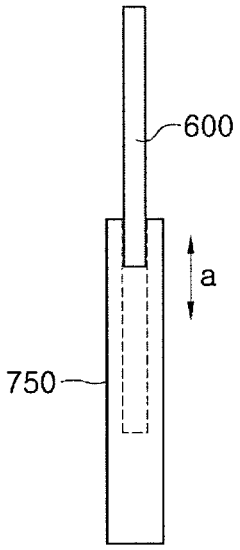
FIG. 4 is a view of a power supply unit including a second power part of the particle separation apparatus according to an embodiment of the present invention.

FIGS. 3 and 4 are views of a power supply unit according to another embodiment of the present invention.

A power supply unit of the particle separation apparatus according to the present invention may be coupled to a lower central portion of the rubber membrane to vertically move the a central part 410 of the rubber membrane, thereby adjusting a volume of the lower space of the body unit 100. That is, when the central part 410 of the rubber membrane is pulled downward, the rubber membrane may be expanded. As a result, the lower space of the body unit 100 may be expanded. On the other hand, when the central part 410 of the rubber membrane is pushed upward, the rubber membrane may be expanded in an opposite direction. As a result, the lower space of the body unit 100 may decrease in volume. As described above, when the lower space of the body unit 100 is expanded or contracted, the mixture W received in the body unit 100 may flow upward or downward. Thus, the mixture W may repeatedly pass through the screen unit 200.

As illustrated in FIG. 3, the power supply unit may include a first power part coupled to the central part 410 of the rubber membrane to vertically move the central part 410 of the rubber membrane in a cam manner. The first power part may provide a rotation force by a manual operation or a motor 900, and the generated rotation force may be transmitted into a rotor 500 to rotate the rotor 500. Here, the first power part further includes a first transmission part 600 that has one end coupled to the rotor 500 and the other end coupled to the central part 410 of the rubber membrane to convert the rotation force of the rotor 500 into a vertical moving force, thereby transmitting the converted vertical moving force into the rubber membrane.

Referring to FIG. 3, when a worker grasps a handle 800 to manually rotate the handle 800, or a first gear 910 is rotated by a rotation force of the motor 900 to rotate a second gear 710 engaged with the first gear 910. Thus, the rotation force transmitted into a power transmission rod 700 connected to the handle 800 and the second gear 710 may be transmitted into the rotor 500 to rotate the rotor 500. Here, the power transmission rod 700 may be supported by a ground support 720 coupled perpendicularly to the ground S.

The rotation force transmitted into the rotor 500 may rotate the rotor 500 in a direction A or a direction opposite to the direction A. Then, the rotation force may be converted into the vertical moving force for pulling or pushing the robber membrane up and downwards by the first transmission part 600 that is eccentrically coupled to the rotor 500. The force for moving the rubber membrane upward or downward may expand or contract the rubber membrane in a direction B of FIG. 1. Thus, the mixture W may repeatedly pass through the screen unit 200 in a direction h while moving in a direction C.

Referring to FIG. 4, a power supply unit according to another embodiment of the present invention will be described. The power supply unit according to another embodiment of the present invention includes a second power part that is capable of pulling or pushing the central part 410 of the rubber membrane in a piston manner. Also, the second power part includes a piston part 750 for providing a vertical moving force and a second transmission part 600 for transmitting the vertical moving force of the piston part 750 into the central part 410 of the rubber membrane.

That is, the downward moving force of the piston part 750 may be transmitted into the rubber membrane by the second transmission part 600 to expand the rubber membrane downward, and the upward moving force of the piston part 750 may be transmitted into the rubber membrane by the second transmission part 600 to expand the rubber membrane upward. As described above, the rubber membrane may be expanded upward or downward to adjust the volume of the lower inner space of the body unit 100.

As described above, in the particle separation apparatus according to the present invention, the soil may be separated by the particle size in the wet-type separation manner. Thus, the mixture of the soil and water may repeatedly pass through the screen to significantly improve the particle separation rate.

Also, like the dry-type sieving separation, the screen may be horizontally vibrated to perform the screen separation, thereby more improving the particle separation rate.

Although effects are not considered herein, the effects described in this specification and their provisional effects, which are expected by the technical features of the present invention, may be considered as the effects described in this specification.

The protective scope of the present invention is not limited to the embodiments that illustratively described above. Further, it will be understood that the protective scope of the present invention is not limited by obvious modifications or substitutions in the technical fields of the present invention.

What is claimed is:

1. A particle separation apparatus for separating soil by particle size in a wet-type separation manner, the particle separation apparatus comprising:

a body unit providing a space in which a mixture of the soil and water is received to flow up and downwards;

a screen unit coupled to the inside of the body unit to separate the soil by the particle size from the mixture that flows up and downwards;

a space adjustment unit coupled to a lower portion of the body unit to cover the lower portion of the body unit, wherein the space adjustment unit comprises a rubber membrane having elasticity, the space adjustment unit adjusting a volume of a lower space of the body unit to allow the mixture to repeatedly flow in a vertical direction; and a power supply unit coupled to a lower portion of the rubber membrane to vertically move a central part of the rubber membrane up and downwards, thereby adjusting the volume of the lower space of the body unit.

2. The particle separation apparatus of claim 1, wherein the power supply unit comprises a first power part coupled to the central part of the rubber membrane to move the central part of the rubber membrane up and downwards in a cam manner.

3. The particle separation apparatus of claim 2, wherein the first power part comprises:

a power source for proving a rotation force by an manual operation or a motor;

a rotor receiving the rotation power from the power source to rotate; and a first transmission part having one end eccentrically coupled to the rotor and the other end coupled to the central part of the rubber membrane to convert the rotation force of the rotor into a vertical moving force, thereby transmitting the converted vertical moving force into the rubber membrane.

4. The particle separation apparatus of claim 1, wherein the power supply unit comprises a second power part coupled to the central part of the rubber membrane to move the central part of the rubber membrane up and downwards in a piston manner.

5. The particle separation apparatus of claim 4, wherein the second power part comprises:

a piston part for providing a vertical moving force; and a second transmission part having one end that is vertically reciprocated within the piston part and the other end coupled to the central part of the rubber membrane to transmit the vertical moving force of the piston part into the central part of the rubber membrane.

6. The particle separation apparatus of claim 1, further comprising a support unit supporting the body unit so that the body unit is spaced apart from the ground.

7. The particle separation apparatus of claim 6, wherein the support unit comprises:

a plurality of supports disposed on the ground; and an elastic support part coupled between each of the plurality of supports and the body unit to allow the body unit to be movable in a lateral direction.

8. The particle separation apparatus of claim 7, wherein the elastic support part comprises a spring.

9. The particle separation apparatus of claim 1, wherein the screen unit is detachably coupled to the body unit.

* * * * *